United States Patent [19]

Hentzschel et al.

[11] Patent Number: 4,476,765

[45] Date of Patent: Oct. 16, 1984

[54] ELECTRONIC MUSIC SIGNAL GENERATOR

[75] Inventors: Hanspeter Hentzschel, Munich; Hermann Hainzlmaier, Rottenegg, both of Fed. Rep. of Germany

[73] Assignee: Eurosil Electronic GmbH, Eching, Fed. Rep. of Germany

[21] Appl. No.: 498,086

[22] Filed: May 25, 1983

[30] Foreign Application Priority Data

May 26, 1982 [DE] Fed. Rep. of Germany ..... 3219731
Oct. 29, 1982 [DE] Fed. Rep. of Germany ..... 3240084

[51] Int. Cl.[3] ..... G10F 1/00

[52] U.S. Cl. ..... 84/1.03; 84/1.01; 84/DIG. 4

[58] Field of Search ..... 84/DIG. 4, 1.01, 1.03, 84/1.24, 1.26; 340/347 M

[56] References Cited

U.S. PATENT DOCUMENTS 4,273,019 6/1981 Goto ..... 84/1.24
4,342,248 8/1982 Deutsch et al. ..... 84/1.24
4,384,505 5/1983 Cotton, Jr. et al. ..... 84/1.24

*Primary Examiner*—Forester W. Isen
*Attorney, Agent, or Firm*—McCormick, Paulding & Huber

[57] ABSTRACT

An electronic music signal generator digitally stores amplitude values representing a complex wave in a number of different memories. By reading out the stored values, under control of a clock circuit, and superimposing them in various ways various effects such as decay can be produced to achieve either single toned or multi-toned sounds closely simulating the sound impression created by mechanical musical instruments.

10 Claims, 4 Drawing Figures

Figure 1:
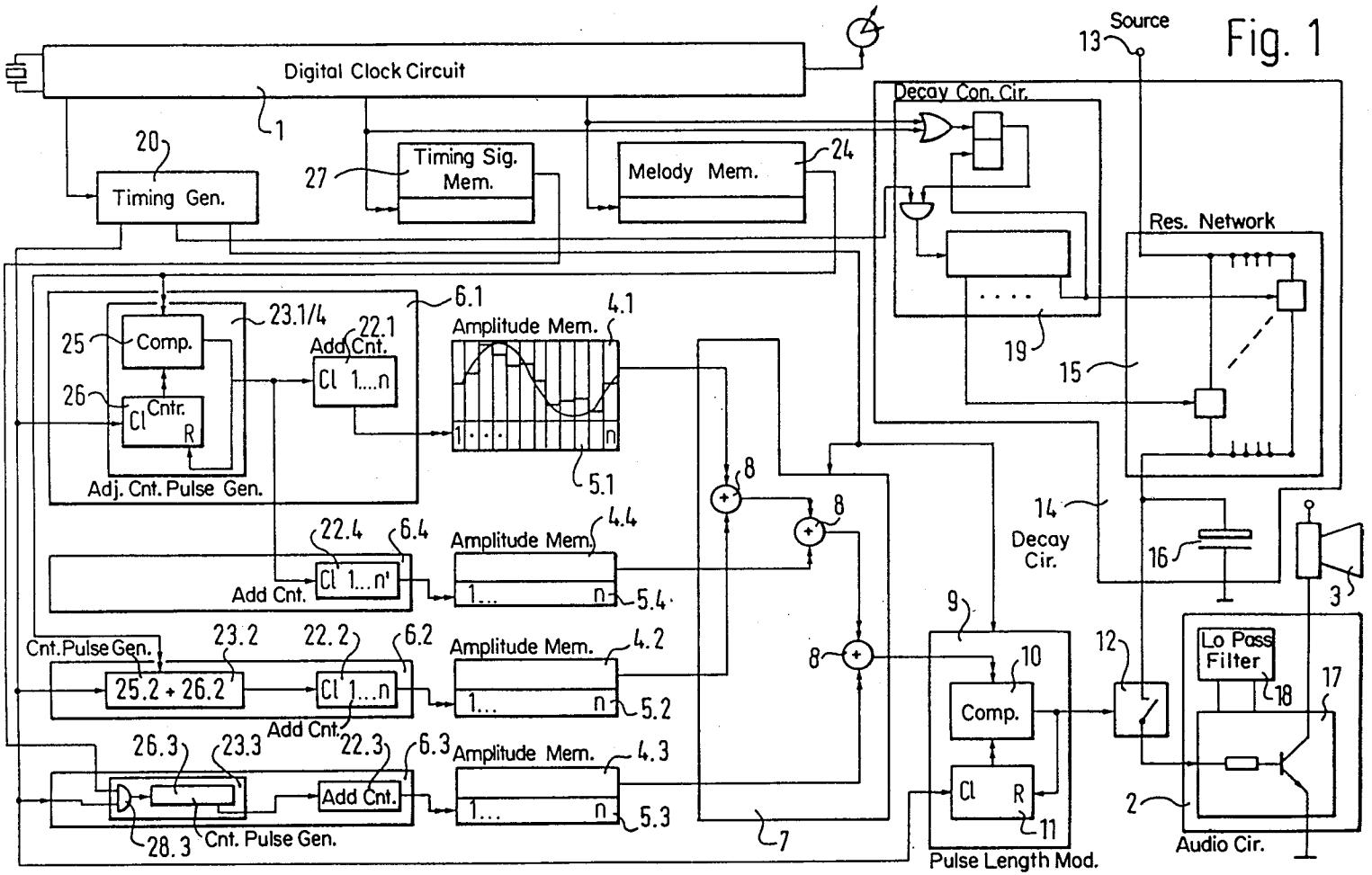

Source
13
Res. Network
15
16
3
17
18
Lo Pass Filter
Audio Cir.
2
12
14
Decay Cir.
19
Decay Con. Cir.
10
Comp.
11
R
Cl
9
Pulse Length Mod.
8
8
8
7
24
Melody Mem.
Digital Clock Circuit
1
Timing Sig. Mem.
27
Timing Gen.
20
4.1
Amplitude Mem.
5.1
6.1
22.1
Add Cnt.
Cl 1...n
23.1/4
Comp.
Cntr.
R
Cl
25
26
Adj. Cnt. Pulse Gen.
4.4
Amplitude Mem.
5.4
6.4
22.4
Cl 1...n'
Add Cnt.
4.2
Amplitude Mem.
5.2
6.2
22.2
Cl 1...n
Add Cnt.
23.2
25.2 + 26.2
Cnt. Pulse Gen.
4.3
Amplitude Mem.
5.3
6.3
22.3
Add Cnt.
23.3
26.3
28.3
Cnt. Pulse Gen.

ELECTRONIC MUSIC SIGNAL GENERATOR

The invention concerns an electronic music signal generator according to the preamble of claim 1.

An apparatus of this kind is known for example from U.S. Pat. No. 4,133,241. A similar device which is equipped with a clock and which serves to create musical signals at definite times, is known from German OS No. 29 39 401.

The previously known devices are poorly suited for manufacture in integrated circuit form because they involve a high expense in circuit design or in the progress of creating the music signal require elements operating in an analog manner (German OS No. 29 39 401). Another disadvantage is that the natural musical impression created by mechanical instruments can only be approximately realized through the electronic signal generators. If a multi-toned signal is to be created from different music signals the circuit design requirements are increased by a corresponding factor. The invention therefore has as its basic object the production of an electronic music signal generator which is better suited than previous ones for implementation with integrated circuit techniques and which at the same time guarantees a better simulation of the sound impression produced by mechanical musical instruments.

This object is solved by the features of patent claim 1. Advantageous further details are the subject of the dependent claims.

The invention makes possible in a very simple way a most far-reaching approach to the natural sound sensation created by a mechanical instrument. Through the reading out of a second amplitude memory with a cycle frequency which corresponds to the previous reading out process of a first amplitude memory the effect is achieved that the previously created sound persists further or dies away. The digital amplitude values which are read out of the two amplitude memories are, after summing, delivered to a pulse length modulator represented by a very simple, and easily realized by integrated circuit techniques, apparatus for digital to analog conversion. In this way, using the longest possible retention of digital signals, a very simple circuit technique is realized which despite its simplicity creates natural sounds which previously were capable of being created only at higher expense.

The further development of the invention according to claim 2 makes possible in a very simple way the creation of a multi-toned sound from different single toned sounds, since the inventive principle of parallel working plural amplitude memories and of the digital to analog conversion through pulse length modulators works independently of whether single toned sounds or mixed tone sounds are created from the read out amplitude values.

The further development according to claim 3 makes possible a further approach to the natural sound sensation since if parallel to the reading out of the first amplitude memory a similar reading out with a slightly changed cycle frequency follows then a beat effect is produced with a beat frequency of for example 0.5 to 16 Hertz as also appears with mechanically produced sounds.

The further development according to claim 4 leads to the result that the sensation of the decay of the previously produced sound is further improved. The same also goes for the further development according to claim 5.

An especially simple circuit design realization of the pulse length modulator is given through the further development according to claim 6. Because the cyclically operating binary counter controls a comparator, a signal is always produced when the count of the binary counter corresponds to the momentary digital amplitude value at the other input of the comparator, by means of which signal the audio circuit is switched in or out. The output signal of the comparator therefore has a length proportional to the count of the binary counter.

For controlling the reading access to the digital memories, address counters are used. The frequency of the count pulses supplied to such an address counter determines the cycle frequency of a music signal generator according to the invention. To produce a predetermined cycle frequency a frequency division can be carried out in accordance with known techniques. In this way not all output frequencies can be obtained because in the digital frequency division integral divisors are necessary. In order to obtain an adequate number of individual tones with relatively exact fundamental frequency relations to one another from a single timing frequency by means of frequency division, the timing frequency and the number of frequency division steps could be so established that the frequency deviations between the individual created tones would be acceptable. This would however lead to a disproportionately high circuit expense and despite this dissonances would appear especially with multi-toned sounds.

Notwithstanding the sense of the given object, in order to achieve intermediate values of frequency with acceptable expense and which intermediate frequencies are not obtainable with integral divisors the invention can be further developed in accordance with claim 7. Here the creation of the output frequency by successive readouts of the amplitude values slightly modifies a pregiven waveform, along with the fundamental frequency being slightly raised or lowered. Through the use of a delay member the cycles of the successive readout procedures are either slightly lengthened or shortened without involving the memory organization. That is, during the cyclic reading out the switching from one memory location to the next is slightly delayed positively or negatively. The result is that for certain fundamental tones which with exact digital frequency division have too large a frequency deviation from the desired value, such frequency deviation can be reduced or avoided. Since the delay information for controlling the delay member is arranged in the melody memory for the music information, the delay influence can be carried out during each cycle at one predetermined address.

This is carried out advantageously at the addresses of such memory places where amplitude values with small relative differences are stored so that no disturbing amplitude jumps are produced by the frequency correction.

Figure 2:
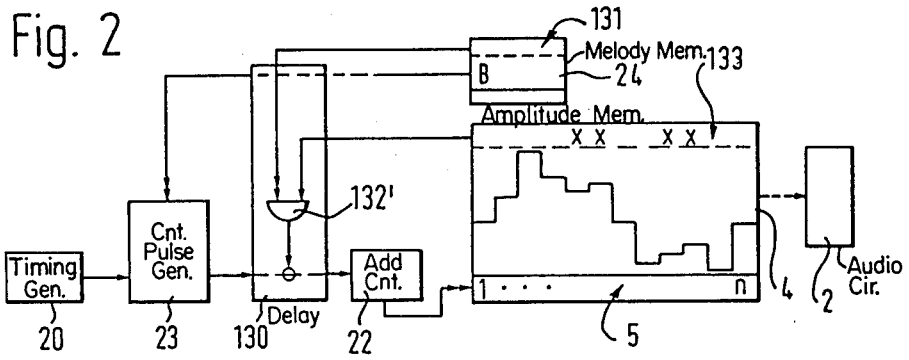
Figure 3:
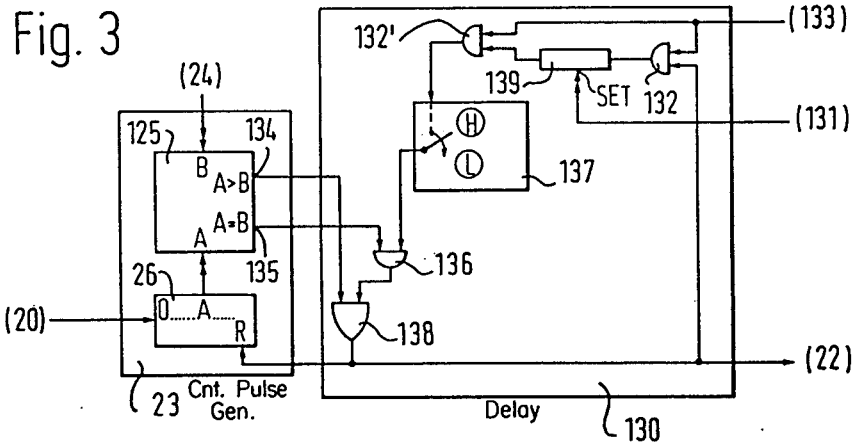
Figure 4:
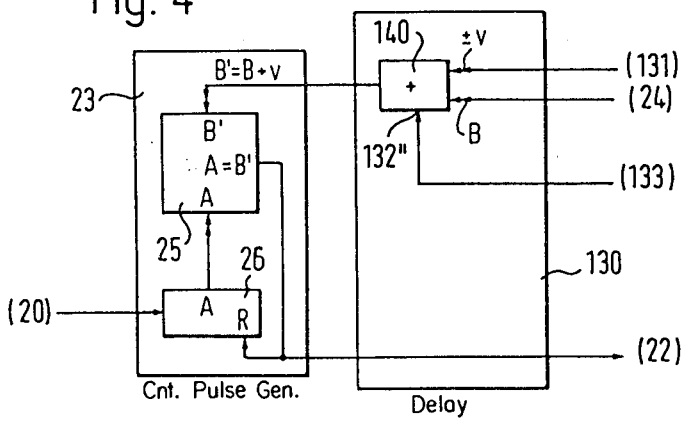

The invention is further explained in connection with the accompanying drawings in which:

FIG. 1 is a circuit diagram of an embodiment of an electronic music signal generator in combination with a clock circuit, FIG. 2 is a circuit diagram showing a further development of the music signal generator in which a correction of the cycle frequency is carried out, FIG. 3 is a circuit diagram showing an embodiment of a delay member for the further development of the circuit of FIG. 2, and FIG. 4 is a circuit diagram showing a further principle of the cycle frequency correction.

FIG. 1 shows as a signal control circuit a digital clock circuit 1 which outputs time signals for the release of music signals at precise times. The music signal generator is controlled by these timing signals and on its part delivers signals to an audio circuit 2 with an electro-acoustic transducer 3. The actual music or sound producing circuit includes several amplitude memories 4.1, 4.2, 4.3, 4.4, which may comprise definite areas, separate from one another of a larger memory. These amplitude memories are preferably fixed read only memories (ROMs) but can also be programmable read only memories (EPROMs). The amplitude memories contain at their individual memory locations, which are addressable through memory addresses 5, digital numerical values corresponding to a sequence of discrete amplitude values of one cycle of a fundamental oscillation on which harmonic overtones are superimposed. FIG. 1 shows a corresponding representation for the first amplitude memory 4.1.

The periodic reading out of the amplitude values results from a periodic control of the memory addresses 5.1, 5.2, 5.3, 5.4, by means of an address counting circuit 6.1, 6.2, 6.3, 6.4. Thereby a musical sound consisting of a fundamental oscillation and harmonic overtones are created wherein the frequency at which the succession of memory addresses are run through is the frequency of the fundamental oscillation and therefore the fundamental frequency of the harmonic overtones.

If after several periods of the fundamental oscillation such fundamental oscillation is to change to another fundamental oscillation, to produce a changed sound, it is only necessary that the amplitude memory 4.1 have its addresses 5.1 addressed at a correspondingly changed frequency from its address counter 6.1, that is with respect to the previous sound the memory addressing is either speeded up or slowed down.

The clock circuit 1 controls these procedures through a timing generator 20 which on its part supplies timing signals to the address counter circuit 6, a digital summing stage 7, a pulse length modulator 9, and to a still to be described decay control circuit 19. The timing generator 20 can inlcude a frequency dividing chain from which timing pulses of different frequencies can be taken. The clock circuit 1 also controls a time signal memory 27 in which digital characteristics for the sequence of sound signals are stored which are to be acoustically reproduced as hour information. A melody memory 24 controlled by the clock circuit 1 contains digital characteristics of a sequence of tones corresponding to a melody to be produced as a music signal, and the melody memory 24 also contains the program for creating the associated sound signals.

The second amplitude memory 4.2 contains largely the same succession of amplitude values as the first amplitude memory 4.1. During the reading out of the first amplitude memory 4.1 the memory 4.2 is addressed by means of its address counter 6.2 with a frequency which corresponds to the cycle frequency of the immediately previous addressing of the amplitude memory 4.1. Therefore in a still to be described way the succession of amplitude values which are read from the second amplitude memory 4.2 can be somewhat modified in order to imitate the natural decay behavior of the previously created sound. In connection with this a reduction of the amplitude values corresponding to the fundamental wave can be carried out and if necessary a comparably proportional reduction of the amplitude values corresponding to the harmonics can also be carried out.

The effect achievable with the second amplitude memory 4.2 is that a superposition of the actual sound with the previously created sound leads to a natural sound sensation whereby the total created sound picture more closely approaches that of a mechanical musical instrument.

The time and amplitude wise superposition of the amplitude values read out of the two amplitude memories 4.1 and 4.2 takes place in a timing signal controlled digital summer 7. This can be built from binary adders 8. It can also be made from comparators which have the effect of a pulse length modulator.

With the use of binary adders 8 data words of constant length are suitably provided. Since the sum of two binary numbers can lead to increasing the data word length by one bit, in the digital summer 7 proper measures are provided to suppress the least significant bit either in the amplitude values to be summed or in the summed signal.

When the music signal generator working in combination with a clock circuit is to emit an hour signal consisting of a plurality of multiple toned sounds similar to one another which indicate the actual time, several amplitude memories like the amplitude memory 4.1 may work parallel with one another. These are then read out by being addressed with different cycle frequencies. In the embodiment shown in FIG. 1 only one additional amplitude memory 4.3 is provided in which a succession of amplitude values are stored which correspond to one multiple toned sound. This therefore takes care of the superposition of the fundamental waves of different tones as well as of their desired harmonics. Because in this distribution of amplitude values all fundamental waves of the multiple tone sounds to be created are contained, only the amplitude memory 4.3 has to be addressed through its addresses 5.3 from its address counter 6.3, whereby the address frequency corresponds to the lowest fundamental tone of the multiple toned sound.

For the musical sensation of a mechanical instrument, along with the time wise superposition of an actual sound with the previously created sound a supplementary loudness modulation is determined on the basis of frequency and phase shifts which vary with time. To create this characteristic feature a fourth amplitude memory 4.4 is provided in FIG. 1 which allows the superposition of the created sound with a sound slightly shifted in frequency. In the amplitude memory 4.4 is stored mainly the sequence of amplitude values as contained in the first amplitude memory 4.1. When this sequence of amplitude values is superimposed with slightly different frequencies of the amplitude values from the first amplitude memory 4.1 the result is a beat effect with a frequency of from about 2 to 16 Hertz. For this purpose the fourth amplitude memory 4.4 can be addressed with a slightly changed frequency. This can for example be done by skipping one counting step in the counter 6.4 which is made similar to the other address counters but in the case of which address counter 6.4 the timing control is taken from out of the address counter 6.1. When the digital summer 7 is made with binary adders 8 it puts out a sequence of binary data words which correspond to the instantaneous value of the superimposed amplitude values from the amplitude memories 4.1, 4.2, 4.3, 4.4. These data words are conducted to a subsequent pulse length modulator 9 in which they are conducted one after the other to the input of a comparator 10 whose second input is controlled by a binary counter 11.

With the acceptance of data words from the digital summer 7 and together with the clearing of the comparator 10 the binary counter 11 is reset and restarted. The comparator 10 delivers for example an output signal which persists until the binary counter 11 reaches a count corresponding to the binary value of the data word last accepted from the digital summer 7. At this moment the output signal of the comparator is switched over to its opposite state. Thereby there is produced at the output of the pulse length modulator 9 an impulse signal whose length within a definite time frame for evaluation is proportional to the binary value of the data word from the digital summer and is therefore proportional to the sum of the amplitude values read out of the amplitude memories 4.

This signal which is output for a length of time until the binary counter 11 effects the switch over of the comparator 10 serves as a control signal for an electronic switch 12 which in FIG. 1 is represented as a set of mechanical switch contacts, but which for example can be realized by a CMOS transmission gate. The switch actuation corresponds to the sound spectrum of the actual sound to be produced and which sound spectrum is given its character by the pulse length modulator, which means that the audio circuit 2, connectable to an energy source 13 through the switch 12, produces the actual sound through the electro-acoustic transducer 3.

In the control of the audio circuit 2, as an additional matter the decay behavior of a mechanical musical instrument can be largely realized. As to this, in the case of the exemplary embodiment shown in FIG. 1 a decay circuit 14 is provided which in general contains a resistance network 15 in series or parallel circuit whose effective resistance value in time dependent steps is enlarged according to a decaying exponential function. Therefore when the reading out of the amplitude memory 4 for the production of a new sound is started there results also an exponential reduction of the sound amplitude or loudness produced by the audio circuit 2 so that each output sound of a sound sequence is damped in a time dependent manner. To achieve a smooth transfer between the steps of the decay function which follow one another a condenser 16 is charged through the resistance network 15 and discharged through the switch 12 and a transistor stage of the audio circuit 2.

The audio circuit 2 also contains a low pass filter 18 for suppressing the higher frequency signal components such as can especially arise in the digital to analog conversion in the pulse length modulator 9. While the audio circuit 10 together with this low pass filter 18 may be made with discrete circuit components, the resistance network 15 may be an integrated circuit made up in the form of integrated transistor elements of different dimensions or power capacities. The insertion or switching in of such elements takes place through the already mentioned decay control circuit 19, timewise controlled through the timing signals of the timing generator 20.

The address counter circuit 6.1 associated with the first amplitude memory 4.1 contains a binary address counter 22 controlled by a variable counting pulse frequency and whose counting capacity corresponds to the address capacity of the memory 4.1. If the counting capacity is quickly gone through, the amplitude memory 4.1 is likewise quickly read out, whereby the sequence of read out amplitude values correspond to a fundamental oscillation with high frequency and corresponding harmonic oscillations. If the address counter 22 is supplied with a lower counting pulse frequency a correspondingly lower frequency fundamental oscillation is obtained. The address counter 22 has connected in circuit ahead of it an adjustable counting pulse producer 23. The counting pulse frequency is dictated by the melody memory 24 which contains the previously mentioned program for the production of music. At definite points in time the signal control circuit 1 initiates the reading out of the individual characteristic values of a sequence of tones from the melody memory 24. Each of the characteristic values for the frequency of the fundamental oscillation of a tone read from the melody memory 24 affects the adjustment of the counting pulse producer 23 to a counting pulse frequency which corresponds to the frequency of the fundamental oscillation of the sound to be created multiplied by the number of addresses of the amplitude memory 4. The address counter circuit 6.2 and 6.3 may be made in a similar manner to that of the address counter circuit 6.1.

For variation of the counting pulse frequency a comparator 25 is provided in the counting pulse producer 23, one input of which comparator is provided with the delivered characteristic value from the melody memory 24 concerning the fundamental oscillation of the sound to be produced. The other input of the comparator 25 contains the output signal of a binary counter, which binary counter 26 is controlled by the timing generator 20 and is reset when it reaches the value of the momentarily delivered characteristic value from the melody memory 24 which gives the fundamental frequency of the sound to be produced. The comparator 25 delivers a reset signal for the binary counter 26 which at the same time serves as a count pulse for the address counter 22. The counting pulse producer 23 therefore works as an adjustable divider for the variable control of the address counter 22 and on its own part is controlled by the timing impulses from the timing generator 20.

Since the amplitude memory 4.4 is to be addressed in the same way as the first amplitude memory 4.1 a single counting pulse producer 23 can be provided for both of the address counting circuits 6.1 and 6.4. In accordance with this the counting pulse producer is indicated inside of the address counting circuit 6.1 with the reference numeral 23.1/4. The two address counting circuits 6.1 and 6.4 contain nevertheless different address counters 22. The address counter 22.4 has a lower count capacity than the address counter 22.1 so that upon the addressing of the amplitude memory 4.4 one or more addresses for the read out of amplitude values are jumped over and the addressing of the amplitude memory 4.4 is started anew before an addressing cycle of the first amplitude memory 4.1 is completed. If for each sound to be produced several address cycles follow one another the cycle length and accordingly the cycle frequency of the amplitude value sequences read from the amplitude memories 4.1 and 4.2 shift at a small frequency so that the acoustic effect of a beat type modulation is produced and with it is produced a close approach to the natural sound senstation of a mechanical instrument.

The address counting circuit 6.2 is not supplied from the melody memory 24 with the characteristic value concerning the fundamental frequency of the actual sound, but instead is supplied with the characteristic value governing the fundamental frequency of the previously created sound. The melody memory 24 is therefore preferably so organized that two characteristic values are stored at each address which two characteristic values correspond to the actual sound and to the previous sound and both of which are conducted to the counting impulse producer 23.1/4 and 23.2.

The time signal memory 27 controlled by the clock circuit 1 conducts its characteristic values for the creation of multiple toned sounds as time defining signals to the address counting circuit 6.3, in which the binary counter 26.3 has connected ahead of it an AND gate 28.3 which receives the characteristic value from the time signal memory 27 and the timing signal from the timing generator 20. Since here no frequency variation comes into play, a comparator 25 can be dispensed with so that the binary counter 26.3 works as a permanently adjusted binary divider. The addressing of the amplitude memory 4.3 takes place therefore always with a constant cycle frequency.

The conductor connections of FIG. 1 indicated with a double arrow are implemented as plural conductors (busses), so that they permit a parallel signal bit transfer. This is especially advantageous in the addressing of the amplitude memories 4 through the memory addresses 5 so that the address 5 to be addressed at any moment is reached with its corresponding binary coded count. An addressing through shift registers would entail a large space requirement if the circuit were made using integrated circuit techniques.

As with the amplitude memory 4, the melody memory 24 and the time signal memory 27 may be individual areas of a larger memory. This can in turn be part of a microprocessor structure to which the address counting circuit 6, the pulse width modulator 9 as well as the digital summers 7 can belong.

When the counting pulse producer 23 is controlled with a definite timing frequency from the timing generator 20 then not all counting pulse frequencies for the address counter 22 can be realized from it as subportions of the timing frequency. In practice the amplitude memory 4 can for example have sixty-four memory addresses in each of which an amplitude value is stored. The timing frequency used for the addressing has for example a frequency of $2^{17}=131{,}072$ Hz. If now the audio circuit 2 is for example to output a sound with a fundamental frequency of 246.7 Hz the counting pulse producer 22 can divide the timing frequency with the numerical value 7 whereby a control frequency for the address counter 22 having a frequency of 292.57 Hz is produced. A division with the numerical value 9 gives a control frequency of 227.56 Hz. To create the fundamental frequency of 246.7 Hz (corresponding to the tone of the musical note h) it is required that the division be made with the numerical value 8.3. Such value cannot be had in the type of address counter circuit shown in FIG. 1 by itself without further development. The same also goes for the creation of other tones from the timing frequency of the timing generator 20 and discrepancies of this type can lead to dissonances.

FIG. 2 shows schematically a circuit arrangement by means of which such discrepancies can be avoided. In this figure those functional units which correspond to similar units of FIG. 1 have been given the same reference number as in FIG. 1. Thus, an amplitude memory 4 is shown which is addressable through memory addresses and which controls the audio circuit 2. The addressing is accomplished by means of the address counter 22 which in turn is controlled by the timing pulse producer 23, which on its own part is controlled through the timing generator 20 and the melody memory 24. Between the timing pulse producer and the address counter 22 a two-state delay member 130 is provided by means of which a positive or negative delay in the switching of the address counter 22 can be created, by means of which a counting pulse or the space between counting pulses can be shortened or lengthened. In each addressing cycle the address capacity of the amplitude memory is therefore run through in a lengthened or shortened amount of time so that despite a definite ratio of division in the counting pulse producer 23 a variation of the finally produced division ratio is introduced which leads to a small reduction or increase in the cycle frequency and therefore in the fundamental frequency of the created sound.

If the melody memory for each fundamental tone to be produced also contains a supplemental piece of delay information 131 which number and/or value gives the delay procedure for each addressing cycle the delay member 130 can be controlled with this delay information 131, whereby the predetermined delay procedure is obtained. The delay member 130 contains an AND gate 132 which is controlled by the delay information 131. Moreover it is also controlled with a piece of division information 133 provided by the amplitude memory 4. This division information has the effect that the disturbance on the counting impulse sequence for the address counter 22 created by the delay member 130 takes place as much as possible, if the amplitude sequence stored in the amplitude memory has a low gradient, between two successive amplitude values having only a small amplitude difference. In the example of FIG. 2 for each memory address 5 a supplementary memory cell x is provided in which a piece of division information 133 can be stored. This division information is in turn stored only at such memory addresses where a small gradient in the amplitude values exists. Through the joining of the delay information 131 and the division information 133 in the AND gate 132 it is assured that the predetermined delay procedure from the melody memory 24 occurs only at points in the amplitude wave shape where such a wave shape has small gradients.

The principle of positive or negative delay shown in FIG. 2 leads already to sufficiently exact fundamental frequencies if during a portion of an addressing cycle the predetermined division factor of the counting pulse producer 23 from the melody memory 24 is raised or lowered by the numerical value one. As to the preceding and taking exemplary numerical values, an actual division factor of eight during forty-five addressing procedures and an actual division factor of nine during the remaining nineteen addressing procedures leads to a control frequency for the address counter 22 of 246.84 Hertz with the resulting deviation of 0.05% from the desired frequency of 246.7 Hertz (the musical tone h) being insignificantly small in comparison to the deviation of 3.77% achieved without the measure provided by FIG. 2.

FIG. 3 shows further details of the circuit of the delay member 130 in combination with the counting pulse producer 23. The combination of these two functional units with their applied control signals or with the address counter 22 are indicated by reference numerals in parentheses.

In the counting pulse producer 23 is a comparator 125 having two outputs 134 and 135 providing the signals A B or A=B dependent on the condition of the input signals A and B which originate from the binary counter 26 and the melody memory 24. In principle this construction corresponds to the construction of the counting impulse producer 23 shown in FIG. 1. The delay member 130 contains an AND gate 132 which on one hand is controlled by the division information 133 and on the other hand by the count signals supplied to it by the address counter 22. The output of the comparator controls a down counter 139 which in turn controls an AND gate 132' which at its second input is similarly controlled by the division information 133. The AND gate 132 controls a two-state switch 137 which in its position H supplies an output signal to an AND gate 136, which at its second input is controlled by the output A=B of the comparator 125. The AND gate 136 controls an OR gate 138 which at its second gate is controlled by the output A B of the comparator 125. The output signal of the OR gate 138 is the reset signal for the binary counter 26 and the count signal for the address counter 22.

When the counting pulse producer 23 works normally and the delay member 130 inserts no delay, the comparator 125 produces the signal A=B at its output 135, when the count A of the binary counter 26 corresponds to the value B supplied as the characteristic value from the melody memory 24. Since moreover the switch 137 in its position H produces a similar signal, the AND gate 136 is switched to a conducting state and effects through the OR gate 138 the giving of a reset pulse to the binary counter 26 and a count pulse to the address counter 22.

If however a delay procedure is to be inserted this means that, for example, the normal division factor of the counting impulse producer 23 is to be raised by the value 1 and namely for certain addresses 5 of the address counter 4 (FIG. 2). This is dependent on the division information 133 and on the delay information 131. If a piece of delay information appears together with a characteristic value from the melody memory 24 the down counter 138 is set. At the same time upon reaching an address 5 of the amplitude memory 4 at which a piece of division information is stored, the AND gate 132 is switched to a conducting state and a down counting step of the down counter 139 is produced. With each down counting step and appearance of a piece of delay information 133 the AND gate 132 is switched to a conducting state and effects a switch over of the switch 137 to the position L in which no output signal is given out. These procedures keep taking place as long as it is possible to count down the down counter 139, that is for so long as the count zero is not reached. The AND gate 136 is closed, however the output 134 of the comparator 129 puts out a signal A B according to the raising of the division factor by the value 1 whereby the OR gate 138 produces a count pulse or reset pulse. Since these have not previously occurred, then the situation is, when the binary counter 26 reaches the count step A=B, or a count step A B, it produces a corresponding later or delayed switching on of the OR gate 138 whereby the counting pulse provided by the OR gate 138 arrives at the address counter 22 as a counting pulse at a later time than it would if produced in the previously described normal case through the AND gate 136.

FIG. 4 shows a circuit arrangement for the counting pulse producer 23 and for the delay member 130, through which strong positive and negative delays can be achieved. In this figure the control of both circuits or the provision of counting pulses is also indicated by means of reference numerals enclosed in parathenses.

The delay member 130 contains an adder 140, which is controlled by the value B (normal division factor) from the melody memory 24 and a signal value ±v from the delay information 131. The adder 140 has a control input 132'', by means of which it can be temporarily cleared, if a piece of division information 131 appears. The comparator 25 holds the output signal of the adder 140 which in the case of the required delay through the delay information 131 can hold the value B+v. This signal is therefore the input signal B' of the comparator 25. When the binary counter 26 reaches the count step A the comparator 25 produces at its output a signal A=B', which is delivered to the binary counter 26 as a reset impulse and to the address counter 22 as a count impulse. It is therefore apparent that the counting frequency of the address counter 22 is changed in accordance with the delay characteristic value ±v.

Therefore, with the arrangement shown in FIG. 4 whenever a piece of division information appears, a delay of ±v is inserted. If this process is only to be used for a definite number of addresses of the amplitude memory 4, hence for example only during one or several definite addressing cycles, then the arrangement of FIG. 4 can also be provided with a down counter 139 of the type shown in FIG. 3, which upon the appearance of a piece of delay information 131 is set to a value corresponding to the number of these addresses. Upon reaching the zero count step no further delay is inserted into the currently occurring address cycle.

We claim:

1. An electronic music signal generator which supplies music signals to an audio circuit under the control of a time dependent signal control circuit, including a clock circuit, through a melody memory containing a sequential sound signal program, with an amplitude memory arrangement for storing discrete digital amplitude values for a period of a complex wave having a fundamental wave and harmonic waves, which amplitude values can be read out at a selectable cycle frequency and after summing are conducted to a digital to analog converter, characterized in that in the amplitude memory arrangement along with one amplitude memory for an actual sound a second amplitude memory is provided having a memory content substantially corresponding to that of the first amplitude memory, in that the second amplitude memory during the reading out of the actual sound is read out by a cycle frequency corresponding to the cycle frequency used in the reading out of the previous actual sound, and in that a pulse length modulator is provided as the digital to analog converter.

2. A music signal generator according to claim 1 characterized in that a third amplitude memory is provided in which a sequence of discrete digital amplitude values are stored which correspond to a multi-toned sound made up of different individual sounds.

3. A music signal generator according to claim 1, further characterized in that a further amplitude memory is provided with a memory content generally corresponding to that of the first amplitude memory which further amplitude memory may be read out during the reading out of the first amplitude memory with a cycle frequency slightly changed with respect to that used in the reading out of the first amplitude memory.

4. A music signal generator according to claim 1, characterized in that the second amplitude memory contains harmonic wave amplitude values, which are reduced with respect to those of the first amplitude memory.

5. A music signal generator according to claim 4, further characterized in that the fundamental wave amplitude values are reduced.

6. A music signal generator according to claim 1 further characterized in that the pulse length modulator contains a comparator controlled by the summed digital amplitude values and by the output signal of a cyclically working binary counter, which comparator has output signals which control the switching in or switching out of the audio circuit.

7. A mucic signal generator according to claim 1 further characterized in that each of said amplitude memories has associated with it an address counter controlling the reading out of the amplitude values stored therein, one of said address counters being controlled by a counting pulse frequency from a melody memory through a working delay member which in turn is controlled by delay information which is associated in the melody memory with a piece of sound information.

8. A music signal generator according to claim 7, further characterized in that the delay member on the one hand is controllable by the delay information and on the other hand is controllable by division information contained in the amplitude memory.

9. A music signal generator according to claim 7 further characterized in that a counting pulse producer for providing the counting pulse frequency has a division ratio changeable by the delay member by the numerical value 1.

10. A music signal generator according to claim 7 further characterized in that the delay member includes an adder which combines the sound information and the associated delay information and produces a control signal for the control of the delay member.

* * * * *